US006447932B1

(12) United States Patent
O'Hara et al.

(10) Patent No.: US 6,447,932 B1
(45) Date of Patent: Sep. 10, 2002

(54) SUBSTRATE STABILIZATION OF SUPERALLOYS PROTECTED BY AN ALUMINUM-RICH COATING

(75) Inventors: Kevin S. O'Hara, Boxford, MA (US); William S. Walston, Mason, OH (US); Jon C. Schaeffer, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/537,647

(22) Filed: Mar. 29, 2000

(51) Int. Cl.[7] ..... C23C 8/24; B23B 7/00

(52) U.S. Cl. ..... 428/627; 428/629; 428/610; 428/699; 428/702; 428/704

(58) Field of Search ..... 428/627, 629, 428/469, 472, 610, 699, 702, 704

(56) References Cited

U.S. PATENT DOCUMENTS 3,989,559 A 11/1976 Lin et al. ..... 419/31
4,004,891 A 1/1977 Lin et al. ..... 75/244
5,252,145 A 10/1993 Tahara et al. ..... 148/206
5,334,263 A 8/1994 Schaeffer ..... 148/217
5,455,120 A * 10/1995 Walston et al.
5,598,968 A * 2/1997 Schaeffer et al. ..... 228/262.31
5,599,404 A 2/1997 Alger ..... 148/212

* cited by examiner

*Primary Examiner*—Deborah Jones
*Assistant Examiner*—Jason Savage
(74) *Attorney, Agent, or Firm*—David L. Narciso; Domenica N.S. Hartman

(57) ABSTRACT

A coating system and method for forming the coating system on an article designed for use in a hostile environment, such as the superalloy turbine, combustor and augmentor components of a gas turbine engine. The method employs a nitrided zone in the surface of the superalloy substrate to inhibit the formation of deleterious topologically-close packed (TCP) phases in the substrate when protected by an aluminum-rich coating and optionally a thermal insulating ceramic layer. Superalloys of particular interest are those containing significant levels of TCP phase-forming elements, such as tungsten, rhenium, tantalum, molybdenum and chromium.

27 Claims, 1 Drawing Sheet

SUBSTRATE STABILIZATION OF SUPERALLOYS PROTECTED BY AN ALUMINUM-RICH COATING

This invention relates to protective coating systems for components exposed to high temperatures, such as the hostile thermal environment of a gas turbine engine. More particularly, this invention is directed to a method of inhibiting the formation of deleterious topologically-close packed (TCP) phases in a superalloy protected by an aluminum-rich coating by nitriding the superalloy surface before depositing the aluminum-rich coating.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high temperature capabilities have been achieved through the formulation of nickel and cobalt-base superalloys. Nonetheless, when used to form components of the turbine, combustor and augmentor sections of a gas turbine engine, such alloys alone are often susceptible to damage by oxidation and hot corrosion attack and may not retain adequate mechanical properties. For this reason, these components are often protected by an environmental and/or thermal-insulating coating, the latter of which is termed a thermal barrier coating (TBC) system. TBC systems typically include an environmentally-protective bond coat and a thermal-insulating ceramic topcoat, typically referred to as the TBC.

To be effective, TBC systems must have low thermal conductivity, strongly adhere to the article, and remain adherent throughout many heating and cooling cycles. The latter requirement is particularly demanding due to the different coefficients of thermal expansion between materials having low thermal conductivity and superalloy materials typically used to form turbine engine components. TBC systems capable of satisfying the above requirements typically employ a bond coat formed of an oxidation-resistant aluminum-containing alloy such as MCrAlX (where M is iron, cobalt and/or nickel, and X is yttrium or another rare earth element), or an oxidation-resistant diffusion coating, such as diffusion aluminide coatings that contain aluminum intermetallics. These same compositions are often used alone as environmental coatings for superalloy components that do not require the added thermal protection of a TBC.

When bond coats and environmental coatings of the type described above are applied, a zone of chemical mixing occurs to some degree between the coating and the superalloy substrate. This zone is typically referred to as a diffusion zone (DZ), and results from the interdiffusion between the coating and substrate. For many alloys, it is typical to see topologically close-packed (TCP) phases in the diffusion zone after high temperature exposures, e.g., near or above about 900° C. The incidence of a moderate amount of TCP phases beneath the coating is typically not detrimental. However, certain high strength superalloys contain significant amounts of refractory elements, such as tungsten, rhenium, tantalum, molybdenum and chromium, which are all components of TCP phases. If these elements, and particularly rhenium, are present in sufficient amounts or combinations, a particularly detrimental type of diffusion zone containing deleterious TCP phases can form after coating. This instability was first seen beneath the diffusion zone of an aluminide coating, and has been termed a secondary reaction zone (SRZ). SRZ and/or its boundaries readily crack under stress and remove useful load-bearing area through its growth into the superalloy substrate.

Commonly-assigned U.S. Pat. No. 5,334,263 to Schaeffer teaches a method of inhibiting the formation of deleterious TCP phases in a superalloy protected by an aluminum-rich coating by carburizing the superalloy surface before depositing the aluminum-rich coating. According to Schaeffer, carbon can be diffused into a superalloy substrate to tie up certain TCP phase-forming refractory elements, and to serve as a barrier between the subsequently-deposited aluminide coating and the superalloy substrate to prevent interaction between the two. However, a limitation to this approach is that only those refractory elements that will form a stable carbide are affected. As a result, an element such as aluminum, which is not a carbide former but important in the occurrence of TCP formation, is not affected by carburization. However, aluminum content is critically related to alloy stability. Increasing the aluminum content in an alloy increases its gamma prime amount. Since refractory elements such as molybdenum, chromium, rhenium and tungsten do not normally partition to the gamma prime phase, their concentration in the remaining gamma phase is increased, producing a higher electron vacancy number and an increased propensity to form detrimental TCP phases.

BRIEF SUMMARY OF THE INVENTION

The present invention generally provides a coating system and method for forming the coating system on an article designed for use in a hostile environment, such as the superalloy turbine, combustor and augmentor components of a gas turbine engine. The method is particularly directed to inhibiting the formation of deleterious topologically-close packed (TCP) phases in a superalloy protected by an aluminum-rich coating and optionally a thermal insulating ceramic layer. Superalloys of particular interest are those containing significant levels of TCP phase-forming elements, such as tungsten, rhenium, tantalum, molybdenum and chromium.

According to this invention, the formation of deleterious TCP phases in the near-surface region of a superalloy substrate can be inhibited by nitriding the substrate prior to depositing the aluminum-rich coating. Within the nitrided surface region, nitrides of the elements of concern will be present, such as aluminum, tantalum and chromium. Titanium, boron, zirconium and niobium nitrides may also be formed if these elements are present in the base alloy. These nitrides are not detrimental to the physical, mechanical and environmental properties of the superalloy if limited to about 10 volume percent within the near-surface region and 20 micrometers in size.

Following nitriding, an aluminum-rich coating can be deposited on the nitrided surface region, yielding an aluminum-rich diffusion zone that extends into the nitrided surface region from the aluminum-rich coating. In a preferred embodiment, the diffusion zone extends into but not beyond the nitrided surface region. During deposition of the coating, less stable nitrides can dissolve and be replaced with more stable nitrides, such that the formation of aluminum nitride continues.

According to the above, appropriately nitriding the surface of a superalloy component serves to form stable nitrides that tie up more TCP phase-forming elements present in the near-surface region of the superalloy than possible by carburizing. By reducing the incidence of detrimental TCP phases, the service life of a superalloy component can be considerably improved, particularly if the superalloy contains relatively high levels, e.g., 5 weight percent or more, of detrimental TCP phase-forming elements such as of aluminum, rhenium, tungsten and/or tantalum.

Other objects and advantages of this invention will be better appreciated from the following detailed description.

DETAILED DESCRIPTION OF THE INVENTION

Figure 1:
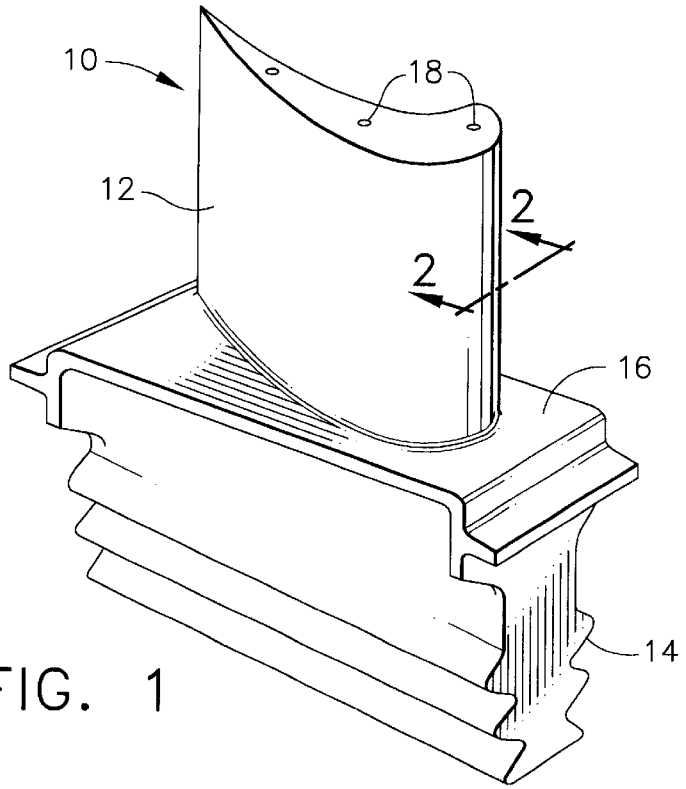
FIG. 1 is a perspective view of a high pressure turbine blade.

The present invention is generally applicable to components that operate within environments characterized by relatively high temperatures, and are therefore subjected to severe thermal stresses and thermal cycling. Notable examples of such components include the high and low pressure turbine nozzles and blades, shrouds, combustor liners and augmentor hardware of gas turbine engines. An example of a high pressure turbine blade 10 is shown in FIG. 1. The blade 10 generally includes an airfoil 12 against which hot combustion gases are directed during operation of the gas turbine engine, and whose surface is therefore subjected to severe attack by oxidation, corrosion and erosion. The airfoil 12 is anchored to a turbine disk (not shown) with a dovetail 14 formed on a root section 16 of the blade 10. Cooling passages 18 are present in the airfoil 12 through which bleed air is forced to transfer heat from the blade 10. While the advantages of this invention will be described with reference to the high pressure turbine blade 10 shown in FIG. 1, the teachings of this invention are generally applicable to any component on which an environmental coating may be used to protect the component from its environment.

Figure 2:
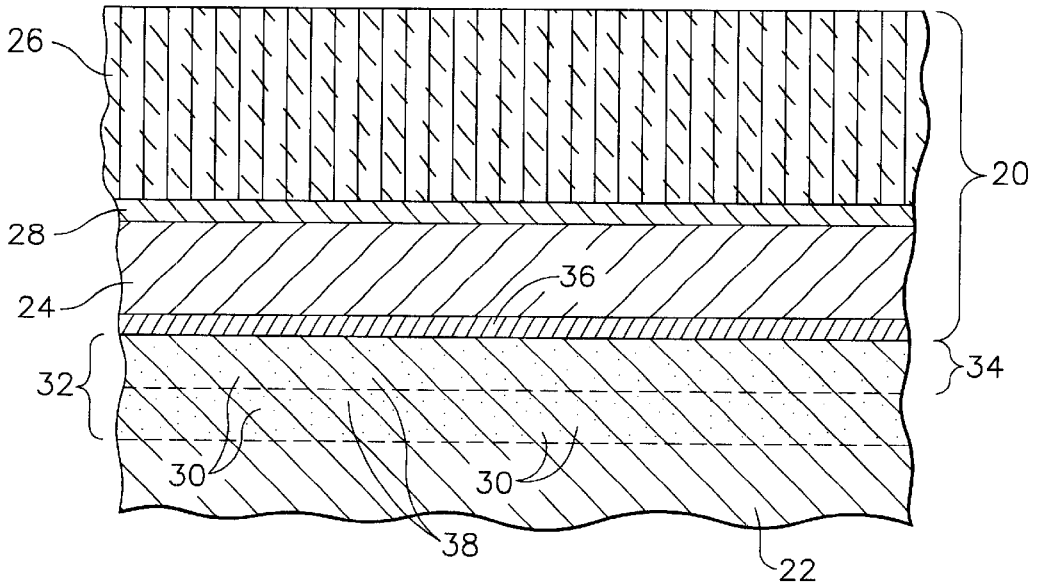
FIG. 2 is a cross-sectional view of the blade of FIG. 1 along line 2—2, and shows a thermal barrier coating system on a nitrided surface region of the blade in accordance with this invention.

Represented in FIG. 2 is a thermal barrier coating (TBC) system 20 of a type known in the art. As shown, the coating system 20 includes a bond coat 24 overlying a superalloy substrate 22, which is typically the base material of the blade 10. The bond coat 24 is shown as adhering a thermal-insulating ceramic layer 26, or TBC, to the substrate 22. Suitable materials for the substrate 22 (and therefore the blade 10) include equiaxed, directionally-solidified and single-crystal nickel-base superalloys, with the invention being particularly advantageous for single-crystal superalloys that contain one or more refractory metals. A notable example is a single-crystal nickel-base superalloy known as Rene N6 disclosed in U.S. Pat. No. 5,455,120. This superalloy nominally contains, in weight percent, about 4.2% chromium, about 1.4% molybdenum, about 5.75% tungsten, about 5.4% rhenium, and about 7.2% tantalum, in addition to various other important alloying constituents.

As is typical with TBC systems for components of gas turbine engines, the bond coat 24 is an aluminum-rich composition, such as a diffusion aluminide, a platinum aluminide, or an MCrAlX alloy of a type known in the art. Aluminum-rich bond coats of this type naturally develop an aluminum oxide (alumina) scale 28, which can be more rapidly grown by forced oxidation of the bond coat 24. The ceramic layer 26 is chemically bonded to the bond coat 24 with the oxide scale 28. Notably, if the bond coat 24 is a diffusion aluminide, a diffusion zone 34 exists beneath the bond coat 24 within the substrate 22. This diffusion zone (DZ) 34 typically extends about 25 to 50 micrometers into the substrate 22, and is comprised of various intermetallic and metastable phases that form during the coating reaction as a result of diffusional gradients and changes in elemental solubility in the local region of the substrate 22. Accordingly, the diffusion zone 34 contains constituents of the substrate 22 and the bond coat 24, and is therefore susceptible to the formation of a secondary reaction zone (SRZ) that contains detrimental TCP phases. If the bond coat 24 is an MCrAlX overlay coating, there is a much shallower diffusion zone 34, corresponding to a somewhat reduced but still detrimental susceptibility to the formation of deleterious SRZ constituents.

As shown, the ceramic layer 26 has a strain-tolerant columnar grain structure achieved by depositing the ceramic layer 26 using physical vapor deposition techniques known in the art, though air plasma spray techniques can also be used. A preferred material for the ceramic layer 26 is an yttria-stabilized zirconia (YSZ), a preferred composition being about 6 to about 8 weight percent yttria, though other ceramic materials could be used, such as yttria, nonstabilized zirconia, or zirconia stabilized by magnesia, ceria, scandia or other oxides. The ceramic layer 26 is deposited to a thickness that is sufficient to provide the required thermal protection for the underlying substrate 22 and blade 10, generally on the order of about 75 to about 300 micrometers.

While described in reference to the TBC system 20 shown in FIG. 2, the present invention is also applicable to environmental coatings that do not include a ceramic TBC (i.e., ceramic layer 26), but instead are limited to an oxidation-resistant coating (e.g., a diffusion aluminide or MCrAlX coating essentially identical to the bond coat 24) and an oxide scale 28.

According to this invention, the coating system 20 is deposited on a nitrided zone 32 in the surface of the substrate 22, i.e., beneath the interface of the bond coat 24 with the substrate 22. The nitrided zone 32 contains nitride precipitates 30 that serve to tie up TCP phase-forming elements such as tungsten, tantalum, chromium, niobium and titanium (when present in the substrate alloy) and TCP phase-promoting elements such as aluminum, in the superalloy substrate 22. In so doing, the nitrided zone 32 inhibits the formation in the substrate 22 of an SRZ containing deleterious TCP-phases, which typically form in the diffusion zone 34 at temperatures near or above about 950° C. (for SRZ). Though the kinetics for nitriding are not as favorable as that for carburization, nitriding provides the capability of tying up more SRZ-forming elements than the carburizing approach taught by U.S. Pat. No. 5,334,263 to Schaeffer, whose teachings are incorporated herein by reference. The nitride precipitates 30 preferably constitute about two to about ten volume percent of the nitrided zone 32, which preferably extends below the diffusion zone 34 of the bond coat 24. Depending on the depth of the diffusion zone 34, the depth of the nitrided zone 32 may be as little as about ten micrometers, but is preferably not deeper than about one hundred micrometers in order to avoid significantly affecting the mechanical properties of the substrate 22. A suitable depth for the nitrided zone 32 is believed to be about twenty-five to seventy-five micrometers below the surface of the superalloy substrate 22. Because nitrogen has a limited solubility of about 2 ppm in nickel and nickel alloys, the overall nitrogen content within the nitrided zone 32 is far above that conventionally present in a nickel-base superalloy. This nitrogen supersaturation of the substrate 22 results in the formation of nitride intermetallic phases.

According to the present invention, the nitrided zone 32 shown in FIG. 2 can further contain carbide precipitates 38 in accordance with Schaeffer. In addition or as an alternative to carburizing, the nitrided zone 32 can be overcoated with a diffusion barrier layer 36 to inhibit interdiffusion between the bond coat 24 and substrate 22.

The nitrided zone 32 of this invention can be formed by several alternate processes, including the use of ammonia or nitrogen-based atmospheres. The resulting nitride dispersion is a strong function of process temperature, time and the substrate alloy. Ammonia-hydrogen mixtures (e.g., containing about 10 to 15 volume percent ammonia) provide a suitable nitriding medium at temperatures from about 700° C. to about 900° C. Nitrogen-hydrogen-helium mixtures (about 50, 5, and 45 volume percent, respectively) can be successfully used from 800° C. to 1050° C. Prior to nitriding, the substrate 22 is cleaned by a chemical, vacuum or controlled abrasive procedure to remove contaminants and surface oxides. After nitriding, conventional processing can be performed to form the bond coat 24, oxide scale 28 and ceramic layer 26 of the coating system 20.

While our invention has been described in terms of a preferred embodiment, it is apparent that other forms could be adopted by one skilled in the art. Accordingly, the scope of our invention is to be limited only by the following claims.

What is claimed is:

1. An equiaxed, directionally-solidified or single-crystal superalloy component comprising:

a superalloy substrate containing TCP phase-forming elements;

a nitrided surface region of the superalloy substrate, the nitrided surface region containing about 2 to about 10 volume percent nitrides;

an aluminum-rich coating on the nitrided surface region; and an aluminum-rich diffusion zone extending into the nitrided surface region from the aluminum-rich coating.

2. A component according to claim 1, wherein the nitrided surface region is characterized by the presence of aluminum nitride and at least one nitride of a refractory metal.

3. A component according to claim 1, wherein the aluminum-rich coating and the aluminum-rich diffusion zone are portions of a diffusion aluminide coating.

4. A component according to claim 1, wherein the superalloy substrate contains aluminum, rhenium, tungsten and tantalum.

5. A component according to claim 1, wherein the nitrided surface region is characterized by a nitride-containing zone that extends about 10 to about 100 micrometers into the superalloy substrate.

6. A component according to claim 1, the component further comprising a ceramic layer on the aluminum-rich coating.

7. A component according to claim 1, wherein the nitrided surface region is characterized by a nitride-containing zone, the component further comprising a diffusion barrier layer overlying the nitride surface region and/or a carburized zone within the nitride-containing zone.

8. A component comprising:

a superalloy substrate containing at least 5 weight percent of at least one metal from the group consisting of rhenium, aluminum, tungsten and tantalum;

a nitrided surface region of the superalloy substrate, the nitrided surface region being characterized by a nitride-containing zone that extends about 25 to about 75 micrometers into the superalloy substrate and contains about 2 to about 10 volume percent nitrides of at least one metal chosen from the group consisting of aluminum, tantalum, chromium, titanium, boron, zirconium and niobium;

a diffusion aluminide coating on the nitrided surface region, the diffusion aluminide coating having a diffusion zone that extends into the nitride-containing zone;

an aluminum oxide layer on the diffusion aluminide coating; and a thermal barrier coating on the aluminum oxide layer.

9. A method of forming a coating system on a surface of a superalloy substrate containing TCP phase-forming elements, the method comprising the steps of:

nitriding the surface of the superalloy substrate to form a nitrided surface region in the superalloy substrate, the nitriding step comprising the steps of exposing the surface of the superalloy substrate to a gaseous atmosphere containing ammonia or nitrogen, and then heating the superalloy substrate to a temperature of about 700° C. to about 1050° C.; and then forming an aluminum-rich coating on the nitrided surface region and an aluminum-rich diffusion zone that extends into the nitrided surface region from the aluminum-rich coating.

10. A method according to claim 9, wherein the nitrided surface region contains aluminum nitrides and at least one nitride of a refractory metal.

11. A method according to claim 9, wherein the aluminum-rich coating and the aluminum-rich diffusion zone are portions of a diffusion aluminide coating.

12. A method according to claim 9, wherein the superalloy substrate contains aluminum, rhenium, tungsten and tantalum.

13. A method according to claim 9, wherein the nitrided surface region is characterized by a nitride-containing zone that extends about 10 to 100 micrometers into the superalloy substrate.

14. A method according to claim 13, wherein the nitride-containing zone contains about 2 to about 10 volume percent nitrides.

15. A method according to claim 16, wherein the nitrided surface region is characterized by a nitride-containing zone that extends further into the superalloy substrate than the aluminum-rich diffusion zone.

16. A method according to claim 9, further comprising the step of depositing a diffusion barrier layer on the nitride surface region prior to forming the aluminum-rich coating, and/or a carburizing the nitride-containing zone prior to forming the aluminum-rich coating.

17. A method according to claim 9, the method further comprising the step of forming a ceramic layer on the aluminum-rich coating.

18. A method according to claim 9, the method further comprising the step of heating the superalloy substrate to at least 950° C. without forming an SRZ constituent in the aluminum-rich diffusion zone.

19. A component comprising:

a superalloy substrate containing TCP phase-forming elements;

a nitrided surface region of the superalloy substrate;

an aluminum-rich coating on the nitrided surface region; and an aluminum-rich diffusion zone extending into the nitrided surface region from the aluminum-rich coating;

wherein the nitrided surface region comprising a nitride-containing zone that extends further into the superalloy substrate than the aluminum-rich diffusion zone.

20. A component according to claim 19, wherein the nitride-containing zone extends about 10 to about 100 micrometers into the superalloy substrate.

21. A component according to claim 19, wherein the nitride-containing zone contains about 2 to about 10 volume percent nitrides.

22. A component according to claim 19, the component further comprising a ceramic layer on the aluminum-rich coating.

23. A component according to claim 19, further comprising a diffusion barrier layer overlying the nitride surface region and/or a carburized zone within the nitride-containing zone.

24. A component comprising:

a superalloy substrate containing TCP phase-forming elements;

a nitrided surface region of the superalloy substrate, the nitrided surface region comprising a nitride-containing zone;

a diffusion barrier layer overlying the nitride surface region and/or a carburized zone within the nitride-containing zone;

an aluminum-rich coating on the nitrided surface region; and an aluminum-rich diffusion zone extending into the nitrided surface region from the aluminum-rich coating.

25. A component according to claim 24, wherein the nitride-containing zone extends about 10 to about 100 micrometers into the superalloy substrate.

26. A component according to claim 24, wherein the nitride-containing zone contains about 2 to about 10 volume percent nitrides.

27. A component according to claim 24, the component further comprising a ceramic layer on the aluminum-rich coating.

* * * * *